US005301760A

United States Patent [19]

Graham

[11] Patent Number: 5,301,760

[45] Date of Patent: Apr. 12, 1994

[54] COMPLETING HORIZONTAL DRAIN HOLES FROM A VERTICAL WELL

[75] Inventor: Stephen A. Graham, Bellaire, Tex.

[73] Assignee: Natural Reserves Group, Inc., Houston, Tex.

[21] Appl. No.: 943,448

[22] Filed: Sep. 10, 1992

[51] Int. Cl.[5] ..... E21B 7/06

[52] U.S. Cl. ..... 175/61; 166/285; 166/386

[58] Field of Search ..... 175/61, 62, 45; 166/379, 267, 421, 285, 386

[56] References Cited

U.S. PATENT DOCUMENTS

| | | | |
|---|---|---|---|
| 2,839,270 | 6/1958 | McCune et al. | 175/61 |
| 4,397,360 | 8/1983 | Schmidt | 175/61 |
| 4,402,551 | 9/1983 | Wood et al. | 175/61 |
| 4,407,367 | 10/1983 | Kydd | 166/267 |
| 4,420,049 | 12/1983 | Holbert | 175/61 |
| 4,601,353 | 7/1986 | Schuh et al. | 175/62 |
| 4,699,224 | 10/1987 | Burton | 175/61 |
| 4,762,186 | 8/1988 | Dech et al. | 175/61 |
| 4,880,067 | 11/1989 | Jelsma | 175/61 |

OTHER PUBLICATIONS

"Reservoir Simulation of Horizontal Wells in the Holder Field", by Zagalai et al., Aug., 1991, JPT.

*Primary Examiner*—Ramon S. Britts
*Assistant Examiner*—Frank S. Tsay
*Attorney, Agent, or Firm*—G. Turner Moller

[57] ABSTRACT

A horizontal bore hole is sidetracked through a window cut in a cased vertical well or from a vertical open hole shaft extending below the kickoff point. In one embodiment, a whipstock is used. In another embodiment, the cased vertical well provides a drillable joint so the window can be cut with a conventional bent housing mud motor from a cement plug located adjacent the drillable joint at the kickoff point. In yet another embodiment, a cement plug is dressed down to the kickoff point in a vertical open hole and is used to start the curved well bore. After drilling at least the curved bore hole, a production string extending into the vertical well is cemented in the curved bore hole and then cut off inside the vertical cased hole with a conventional burning shoe/wash pipe assembly. The whipstock or cement plug is removed to clear the vertical well to a location below the entry of the horizontal well bore. Multiple horizontal wells may be drilled. Any open hole portions of the vertical well are cased with a liner. A downhole pump may be provided in the vertical well below the entry of the horizontal well bore. In addition to one or more horizontal completions, one or more productive intervals can be perforated through the vertical well to provide vertical completions.

21 Claims, 3 Drawing Sheets

COMPLETING HORIZONTAL DRAIN HOLES FROM A VERTICAL WELL

This invention relates to completing one or more horizontal drain holes from a new or existing vertical well.

Horizontally drilled wells have recently become quite popular in attempting to make commercial wells in vertically fractured formations, such as the Austin Chalk or Bakken Shale. Horizontally drilled wells also have many advantages in conventional sandstone reservoirs because of the much improved linear flow characteristics rather than the radial flow characteristics inherent in vertical wells. Horizontal wells typically exhibit greater productivity than vertical wells because more of the formation is exposed to the well bore.

Conventional horizontal completions leave much to be desired in a variety of respects. Because of the way most of the horizontal well bore sections are currently drilled, mechanical pumps are commonly located in the vertical or near vertical portion of the well at a substantial vertical distance above the horizontal well bore. This leads to inefficiencies in pumping liquids from the well. It is much more desirable to position the pump at a location in the well below any producing horizon. In addition, it is desirable in some situations to combine horizontal and vertical completions from the same formation and have them produce into the same vertical well bore. This configuration would enable a formation to be produced to a lower bottomhole pressure than would be possible if the pump were located near the horizontal kickoff point in the vertical portion of the well. It is also desirable in some situations to complete multiple horizontal completions and have them produce into the same vertical well bore. Completing a vertical well in one or more formations in a conventional manner together with horizontal drain hole completions extending from the same vertical well bore is advantageous in many circumstances because it maximizes the efficiency of the downhole and surface equipment associated with the vertical well.

In accordance with this invention, a window is cut in a cased vertical well and a bore hole is sidetracked through the window or a curved well bore is kicked off from a vertical open hole. Angle is built up in a curved well bore until the bore hole is more-or-less horizontal. The horizontal well bore is drilled a substantial distance into a hydrocarbon bearing formation. A production string is run into the well so it extends from adjacent the horizontal well bore, through the curved well bore section and into the vertical cased hole or vertical open hole. The well is cemented so at least the curved portion of the well bore includes an impermeable sheath around the production string isolating the production string from permeable formations above the pay zone and isolating the top of the pay zone. After the cement cures, that portion of the production string extending into the vertical cased hole or vertical open hole is cut off by the use of a conventional full gauge burning shoe/wash pipe assembly, leaving a relatively clean intersection between the curved and vertical well bore sections. Another horizontal well bore section may be drilled and completed off the vertical hole into the same or a different hydrocarbon bearing formation. If a horizontal well bore is drilled from a vertical open hole, the vertical open hole may be cased with a liner after completing the horizontal drilling operation. It will be seen that a pump may be run into the vertical cased well and placed below all of the entries between the horizontal and vertical well bores. In addition, it will be seen that one or all of the hydrocarbon bearing formations may also be perforated in the vertical well to provide both vertical and horizontal completions producing into the same vertical cased well.

One object of this invention is to provide an improved technique for completing horizontal well bores.

A further object of this invention is to provide a technique for completing horizontal well bores in which a mechanical pump may be placed below the entry of the horizontal well bore into the vertical well.

Another object of this invention is to provide a technique for completing hydrocarbon wells so there are both vertical and horizontal completions producing into the same vertical cased well.

These and other objects of this invention will become more fully apparent as this description proceeds, reference being made to the accompanying drawings and appended claims.

IN THE DRAWINGS

Figure 1:
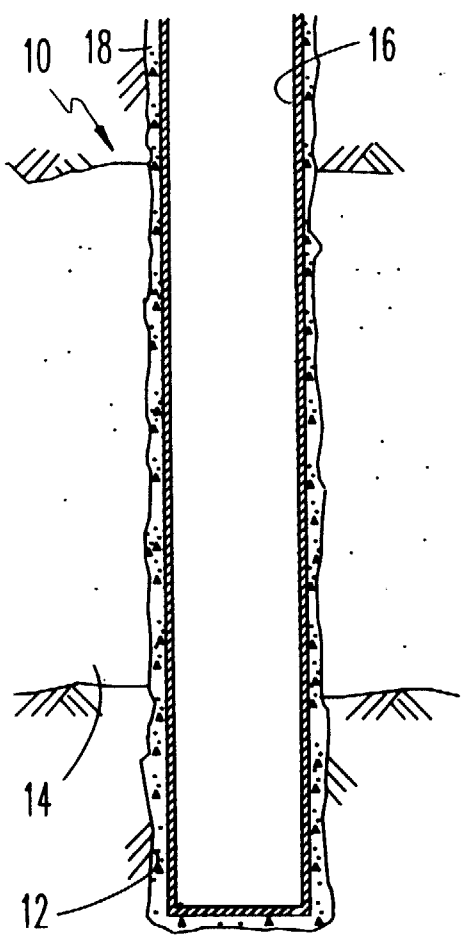
FIG. 1 is a schematic cross-sectional view of a vertical cased well extending through a subterranean hydrocarbon bearing formation.

Referring to FIG. 1, a vertical cased well 10 comprises a well bore 12 drilled into the earth to penetrate a subterranean hydrocarbon bearing formation 14. Typically, the well bore 12 is logged to provide reliable information about the top and bottom, porosity, fluid content and other petrophysical properties of the formations encountered. A relatively large casing string 16, e.g. 7" O.D. or greater, is cemented in the well bore 12 in any suitable manner so an impermeable cement sheath 18 prevents communication between formations in the annulus between the well bore 12 and the casing string 16.

Figure 2:
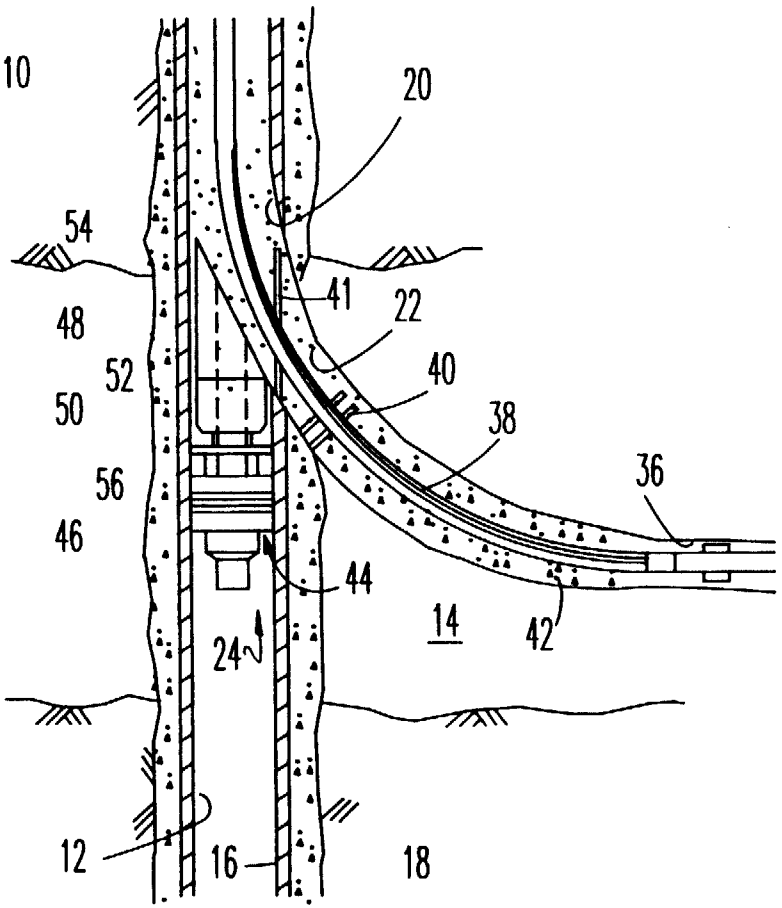
FIG. 2 is a schematic cross-sectional view showing a technique of drilling and completing a horizontal drain hole in accordance with this invention.

Referring to FIG. 2, a window 20 is cut in the casing string 16 and a curved bore hole 22 is drilled, preferably on a short or medium radius, to intersect the formation 14. In accordance with one technique, the window 20 is cut by using a whipstock 24 set in the vertical cased well 10 where the well is to be sidetracked and the window 20 is conventionally cut with a mill (not shown).

Figure 3:
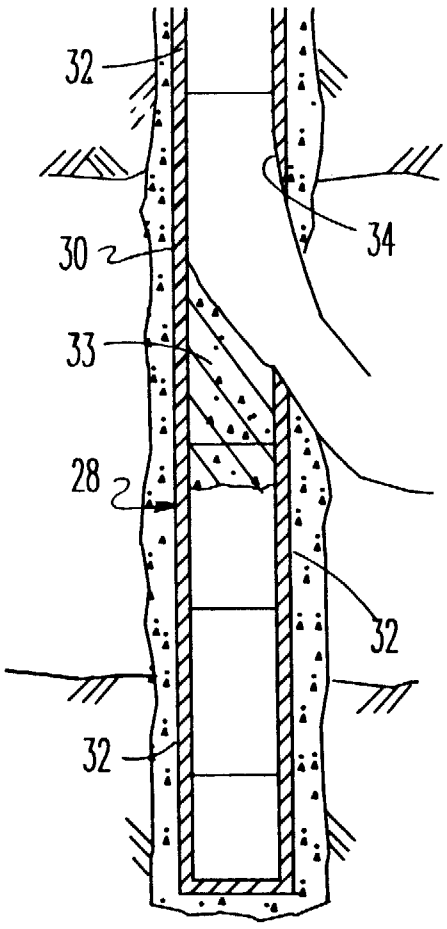

In the alternative, if the vertical cased well 10 is drilled and cased with this in mind, as opposed to reentering an old well or conventionally completing the well 10, the window may be cut in a different manner. As shown in FIG. 3, a well 26 includes a casing string 28 having a drillable joint 30 made of a carbon/glass-/epoxy composite material and a plurality of conventional steel joints 32. Because the joint 30 is much easier to drill than the steel joints 32, a cement plug 33 is placed in the well 26 and then dressed down to the kickoff point. A window 34 is then cut in the joint 30 with a conventional bent housing mud motor assembly (not shown). It may be advantageous in some situations to initiate the kickoff with a whipstock/packer assembly (not shown) instead of the cement plug 33.

Figure 4:
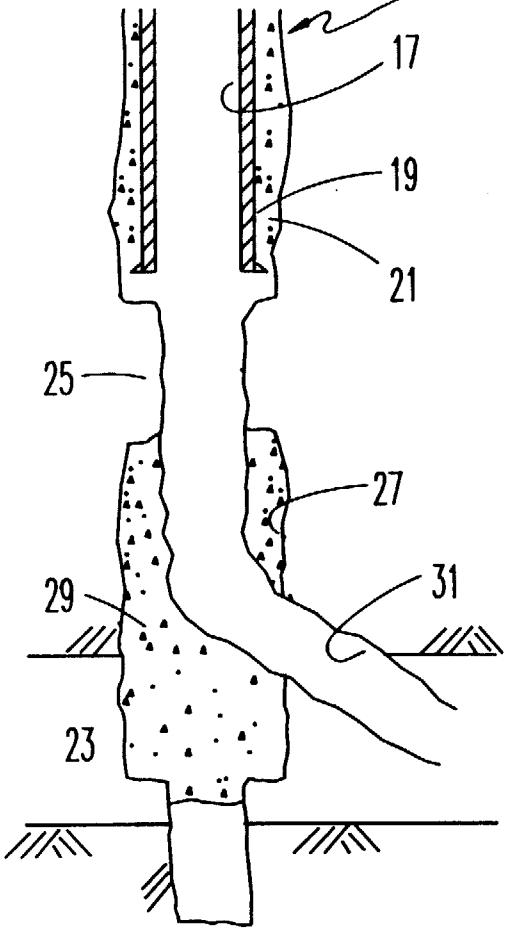
FIGS. 3 and 4 are schematic cross-sectional views showing alternate techniques for sidetracking the hole and drilling the curved well bore.

Referring to FIG. 4, a somewhat different situation is illustrated. A well 15 includes a vertical bore hole 17 having steel casing 19 cemented therein by a cement sheath 21 above a target hydrocarbon bearing formation 23. A vertical open hole 25 is drilled below the casing string 19 to a point below the formation 23. After logging the open hole 25 for formation evaluation purposes, a portion 27 of the vertical open hole 25 is enlarged using conventional underreaming techniques. A cement plug 29 is pumped into the enlarged open hole 27 adjacent the kickoff point and then dressed off after the plug has hardened. A conventional bent housing mud motor assembly (not shown) is then used to drill the curved bore hole 22 in a conventional manner.

In any event, the curved portion of the well bore is begun. Referring back to FIG. 2, a curved bore hole section 22 is drilled toward the hydrocarbon bearing formation 14. Either before or after drilling a horizontal well bore 36 into the formation 14, a pipe string 38 is run through the window 20 at least into the curved bore hole 22 so it extends upwardly into the well 10. The pipe string 38 provides thereon a plurality of centralizers 40 and a plurality of reinforcing members 41. The centralizers 40 support the pipe string 38 off of the bottom of the curved bore hole 22 and the members 41 act to reinforce cement adjacent the window 20 as will be more fully apparent hereinafter. The reinforcing members 41 are positioned on the pipe string 38 so they partially fill the annulus between the curved bore hole 22 and the string 38 in the immediate area of the window 20. The reinforcing members 41 may comprise lengths of the same type wire as used in wire casing scratchers. For reasons more fully apparent hereinafter, the pipe string 38 may wholly or partially comprise joints of drillable material such as a carbon/fiberglass-/epoxy composite.

Cement 42 is pumped through the pipe string 38 to surround the pipe string 38, close off the window 20 and extend upwardly into the cased vertical well 10. This prevents formations above the hydrocarbon bearing formation 14 from sloughing off through the window 20 into the vertical well 10, prevents water from formations above the formation 14 from entering the cased vertical well 10 and prevents gas or steam from entering the well 10 from adjacent the top of the formation 14.

The horizontal well bore 36 may be completed in a conventional manner, such as in the open hole or through perforations, or as shown in copending U.S. application Ser. No. 07/920,804, filed Jul. 24, 1992, the disclosure of which is incorporated herein by reference.

After the cement 42 sets up, that portion of the cement 42 and the production string 38 inside the vertical cased well 10 is drilled up. Preferably, the production string 38 is filled with a viscous, low residue, high gel strength water based, temporary blocking agent to minimize the amount of cement and pipe cuttings that enter the curved and horizontal sections of the well.

Drilling of the cement 42 and production string 38 is accomplished by use of a conventional full bore burning shoe/washpipe assembly. Although any suitable burning shoe may be used, a typical choice would be a Type D Rotary Shoe from Tri-State Oil Tools which cuts on the bottom of the shoe and on the inside. Basically, the burning shoe cuts away the periphery of the cement 42 and production string 38, leaving a core shaped remnant which is caught by an internal catch device (not shown) located above the washpipe or with a conventional fishing tool run after the burning shoe/wash pipe assembly is retrieved. If a cement plug is used to initiate the curved bore hole section 22 as in FIGS. 3 and 4, then the vertical cased well or the vertical open hole 25 is configured to drill another horizontal drain hole using similar techniques or a production liner is run.

If a whipstock is used to initiate the curved bore hole section 22 as in FIG. 2, the preferred whipstock 24 is a modified version of that shown in U.S. Pat. No. 5,113,938. In this type whipstock, a lower assembly 44 includes a packer 46 for anchoring the whipstock 24 at a desired location. A wedge shaped upper end 48 is pivoted by a pair of short pins 50 to the lower assembly 44. An axial passage 52 extends through the upper end 48 past the pivot pins 50 to receive a setting tool (not shown). The setting tool (not shown) holds the upper end 48 in alignment with the lower assembly 44 as the whipstock 24 is run into the well 10. When the packer 46 is set and the setting tool (not shown) removed, the upper end 48 pivots about the pin 50 into engagement with the casing 16.

The whipstock 24 has been modified in two respects. First, a drillable shoulder 54 has been provided to position the upper end 48 away from the casing 16. Second, a locator ring 56 of a drillable metal is incorporated in the lower assembly 44. As the cement 42 and production string 38 are being cut away by the burning shoe (not shown), the drillable shoulder 54 allows the burning shoe to get behind the wedge shaped upper end 48 to cut the cement 42 and production string 38 below the top of the wedge shaped upper end 48. The locator ring 56 provides an indication to the driller that the burning shoe is past the window 20 and the location of the bottom of the burning shoe is immediately above the pack-off elements of the packer 46. When the burning shoe completes drilling of the production string 38, only cement will be drilled for a somewhat variable distance, e.g. two-three feet, between the bottom of the production string 38 and the locator ring 56. Because the locator ring 56 is a drillable metal, the driller will realize that metal is being cut again by the burning shoe. The thickness of the locator ring 56 is known, so the driller can recognize when it has been drilled through. It will be seen that the reinforcing elements 41 act, much as rebar in poured concrete, to reinforce the cement 42 adjacent the window 20. In addition, fibrous material, such as Halliburton's TUF cement additive disclosed in U.S. Pat. No. 3,774,683, may be added to the cement to make the hardened cement less brittle with more resiliency to shock and vibration loading.

Figure 5:
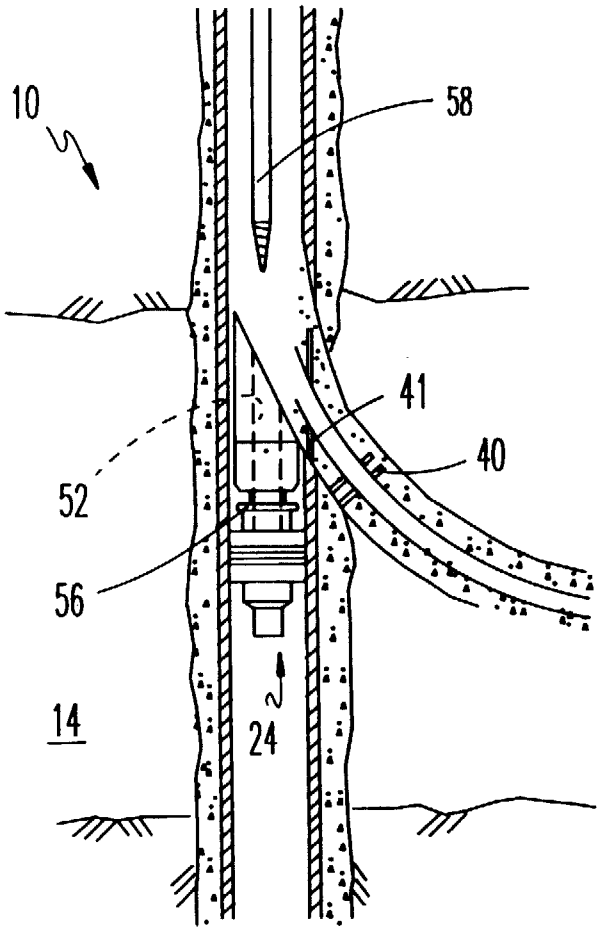
FIG. 5 is a schematic cross-sectional view of a subsequent stage of drilling and completing a horizontal drain hole in accordance with this invention.

After the locator ring 56 is drilled up, the hole is circulated to remove all cement and pipe cuttings and the burning shoe/wash pipe assembly and its captive cement-pipe remnant is removed from the well leaving the situation as shown in FIG. 5. The whipstock 24 is then removed from the vertical cased well 10 using any suitable fishing tool such as a taper tap 58. The axial passage 52 is partially cleaned out by advancing and rotating the taper tap 58 into the passage 52 and pumping therethrough. The taper tap 58 is lowered into the passage 52 until it torques up and catches or anchors in the whipstock 24. Picking up on the taper tap 58 unseats the packer 46. If the packer 46 is an inflatable packer, as is preferred, picking up on the taper tap 58 shears the packer deflation pin thereby allowing the packer 46 to deflate. The whipstock 24 is thereby released from securement to the casing 16 and is removed from the cased vertical well 10.

Figure 6:
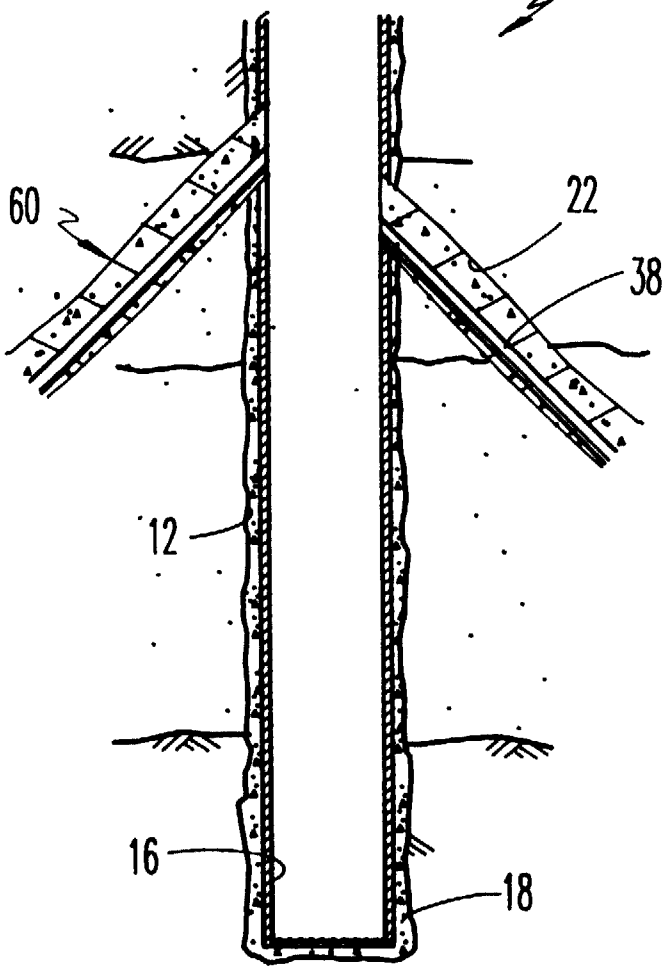
FIG. 6 is a schematic cross-sectional view of a second horizontal well bore drilled from a cased vertical well.

As shown in FIG. 6, another horizontal completion 60 may be provided to produce into the vertical cased well 10, using the same techniques as previously discussed.

Figure 7:
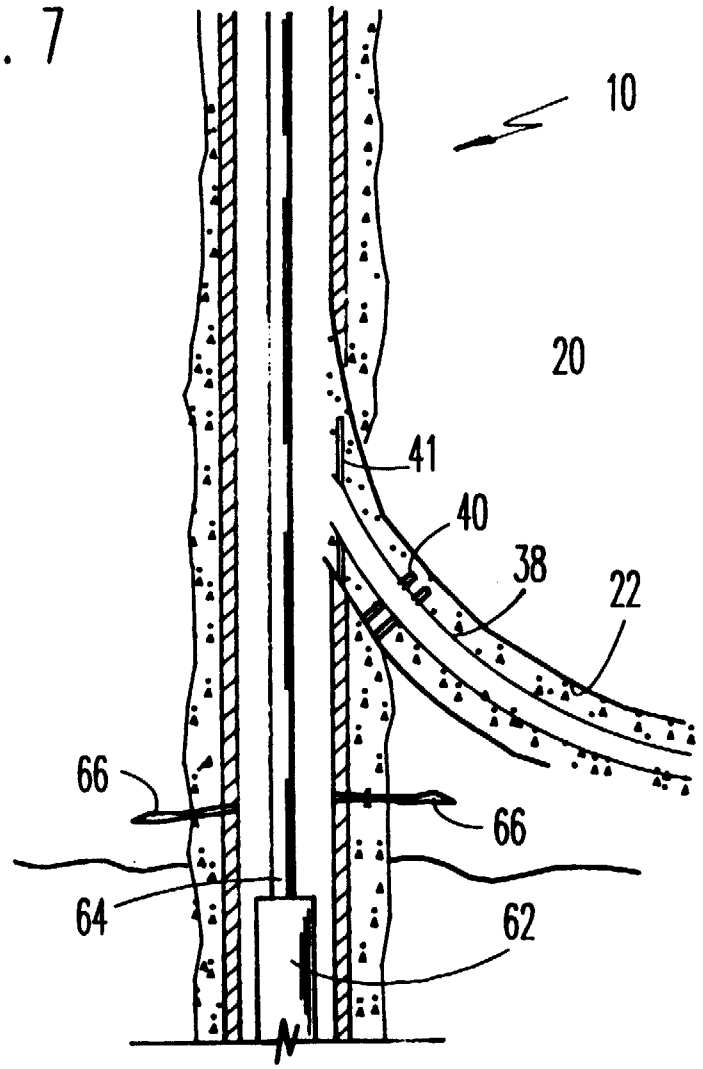
FIG. 7 is a schematic cross-sectional view of a completed well having both horizontal and vertical completions.

As shown in FIG. 7, the well 10 may then be completed by running a downhole pump 62 on the end of a tubing string 64 below the entry of the production string 38 into the vertical well 10. If desired, perforations 66 may be shot through the casing 16 to complete the formation into the vertical cased well 10 as a vertical completion as well as the horizontal completion through the production string 38.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. In a process of completing a horizontal well in a hydrocarbon formation comprising the steps of providing a vertical well, drilling a curved well bore from the vertical well, drilling a horizontal well bore into the formation through the curved well bore, positioning a first section of a pipe string in the curved well bore and a second section of the pipe string in the vertical well, and cementing the pipe string in the curved well bore, the improvement comprising comminuting the pipe string in the vertical well and thereby providing a passage between the horizontal well bore section and the vertical well and then producing hydrocarbons from the horizontal well bore section through the passage into the vertical well.

2. The process of claim 1 wherein the providing step comprises drilling a vertical open hole and then drilling the curved well bore by sidetracking from the vertical open hole at a location above the bottom of the vertical open hole.

3. The process of claim 1 wherein the providing step comprises providing a vertical cased well and cutting a window through the vertical cased well and then drilling the curved well bore through the window.

4. The process of claim 1 wherein the step of drilling the curved well bore comprises setting a plug in the vertical well and then drilling the curved well bore at a location starting above the bottom of the plug and further comprising the steps of removing the plug from the vertical well to provide a sump below an intersection of the curved well bore and the vertical well, placing a pump in the sump and the producing step comprises pumping liquid hydrocarbons from the sump upwardly through the vertical well.

5. The process of claim 4 wherein the plug is a hardened pumpable impermeable material.

6. The process of claim 4 wherein the plug is a whipstock and the removing step comprises retrieving the whipstock upwardly through the vertical well.

7. The process of claim 6 wherein the whipstock includes a drillable locator and the retrieving step includes drilling the locator.

8. The process of claim 6 wherein the whipstock includes a lower assembly including means for anchoring the whipstock to the vertical cased well, a wedge shaped upper assembly, means pivoting the upper assembly on the lower assembly and a drillable shoulder on the upper assembly for standing the upper assembly away from the vertical cased well and the retrieving step includes drilling the drillable shoulder.

9. The process of claim 1 wherein the vertical well extends substantially into the subterranean formation and further comprising the step of establishing a radial flow pattern from the formation into the vertical well at a location below an intersection of the curved well bore and the vertical well.

10. The process of claim 9 wherein the vertical well is a vertical cased well and the establishing step comprises perforating the vertical cased well at a vertical elevation corresponding to the formation.

11. The process of claim 1 wherein the cementing step comprises affixing a plurality of radial metallic elements to the pipe string along a predetermined zone, running the pipe string into the well and positioning the zone at a location below an intersection of the curved well bore and the vertical well, and filling up an annulus between the pipe string and the curved well bore with a hardenable impermeable material and the comminuting step comprises comminuting the pipe string and cement in the vertical well.

12. The process of claim 1 wherein the vertical well comprises a multiplicity of joints of hard-to-drill metal joints and at least one joint of a drillable material substantially easier to drill than the hard-to-drill metal, and wherein the step of drilling a curved well bore comprises cutting a window through the joint of drillable material.

13. The process of claim 1 wherein the comminuting step comprises drilling up the pipe string and cement in the vertical well and circulating cuttings of the pipe string and cement upwardly out of the vertical well.

14. The process of claim 13 wherein the drilling up step comprises cutting an annulus through the pipe string and cement in the vertical well to produce a remnant of pipe string and cement and removing the remnant upwardly through the vertical well.

15. A process comprising drilling a well bore into the earth, running a casing string into the well bore including a plurality of first joints of hard-to-drill metal pipe and at least one second joint of pipe of a material easier-to-drill than the first joints, and cutting window in the casing string through the second joint.

16. A well having a first vertical cased section extending into and communicating with a subterranean hydrocarbon bearing formation, a curved well bore section extending away from the first vertical cased section at a location above the bottom of the formation, a horizontal well bore section extending away from the curved well bore section and into the formation, a second vertical cased section extending below the curved well bore section and means for producing a first stream of hydrocarbons from the horizontal well bore section and a second stream of hydrocarbons from the second vertical cased section.

17. The well of claim 16 further comprising means commingling the first and second streams in the vertical cased section at a location above an intersection between the vertical cased well and the curved well bore section.

18. The well of claim 16 wherein the vertical cased section communicates with the formation through perforations.

19. The well of claim 16 wherein the formation is in a radial flow pattern with the vertical cased section and is in a second flow pattern with the horizontal well bore different than the radial flow pattern.

20. The well of claim 19 further comprising a pump in the vertical cased section below the top of the formation.

21. The well of claim 20 wherein the pump is below the bottom of the formation.

* * * * *

US005301760C1

(12) REEXAMINATION CERTIFICATE (4590th)

United States Patent

Graham

(10) Number: US 5,301,760 C1

(45) Certificate Issued: Jun. 11, 2002

(54) COMPLETING HORIZONTAL DRAIN HOLES FROM A VERTICAL WELL

(75) Inventor: Stephen A. Graham, Bellaire, TX (US)

(73) Assignee: Natural Reserve Group, Inc., Houston, TX (US)

Reexamination Request:
No. 90/005,672, Mar. 8, 2000

Reexamination Certificate for:

| | |
|---|---|
| Patent No.: | **5,301,760** |
| Issued: | **Apr. 12, 1994** |
| Appl. No.: | **07/943,448** |
| Filed: | **Sep. 10, 1992** |

(51) Int. Cl.[7] ..... E21B 7/06

(52) U.S. Cl. ..... 175/61; 166/285; 166/386

(58) Field of Search ..... 175/45, 61, 62; 166/329, 267, 421, 285, 386

(56) References Cited

U.S. PATENT DOCUMENTS

| | | | |
|---|---|---|---|
| 1,507,717 | A | 9/1924 | Rich |
| 1,520,737 | A | 12/1924 | Wright |
| 1,734,033 | A | 11/1929 | Geis |
| 1,735,012 | A | 11/1929 | Rich |
| 1,804,819 | A | 5/1931 | Spencer et al. |
| 1,816,260 | A | 7/1931 | Lee |
| 1,900,163 | A | 3/1933 | Dana |
| 1,900,164 | A | 3/1933 | Dana et al. |
| 1,901,454 | A | 3/1933 | Kelly |
| 1,923,448 | A | 8/1933 | McCoy et al. |
| 2,043,225 | A | 6/1936 | Armentrout et al. |
| 2,058,327 | A | 10/1936 | Lane |
| 2,118,650 | A | 5/1938 | Lee |
| 2,147,537 | A | 2/1939 | Lowrey |
| 2,155,129 | A | 4/1939 | Hall et al. |
| 2,164,266 | A | 6/1939 | Armentrout et al. |
| 2,171,416 | A | 8/1939 | Lee |
| 2,173,035 | A | 9/1939 | Armentrout et al. |
| 2,198,016 | A | 4/1940 | Rogers et al. |
| 2,205,119 | A | 6/1940 | Hall et al. |
| 2,211,803 | A | 8/1940 | Warburton |
| 2,271,005 | A | 1/1942 | Grebe |

(List continued on next page.)

FOREIGN PATENT DOCUMENTS

| | | |
|---|---|---|
| GB | 2282835 | 4/1995 |
| GB | 2295840 | 6/1996 |
| SU | 787 611 | 12/1980 |

OTHER PUBLICATIONS

787611; Translation Union of Soviet Socialist Republics; Specification of the Invention Pertinent to Author's Certificate Published Dec. 15, 1980.

"Lateral Drain Hole Drilling" *The Petroleum Engineer,* Mar. 1955.

(List continued on next page.)

*Primary Examiner*—William Neuder

(57) ABSTRACT

A horizontal bore hole is sidetracked through a window cut in a cased vertical well or from a vertical open hole shaft extending below the kickoff point. In one embodiment, a whipstock is used. In another embodiment, the cased vertical well provides a drillable joint so the window can be cut with a conventional bent housing mud motor from a cement plug located adjacent the drillable joint at the kickoff point. In yet another embodiment, a cement plug is dressed down to the kickoff point in a vertical open hole and is used to start the curved well bore. After drilling at least the curved bore hole, a production string extending into the vertical well is cemented in the curved bore hole and then cut off inside the vertical cased hole with a conventional burning shoe/wash pipe assembly. The whipstock or cement plug is removed to clear the vertical well to a location below the entry of the horizontal well bore. Multiple horizontal wells may be drilled. Any open hole portions of the vertical well are cased with a liner. A downhole pump may be provided in the vertical well below the entry of the horizontal well bore. In addition to one or more horizontal completions, one or more productive intervals can be perforated through the vertical well to provide vertical completions.

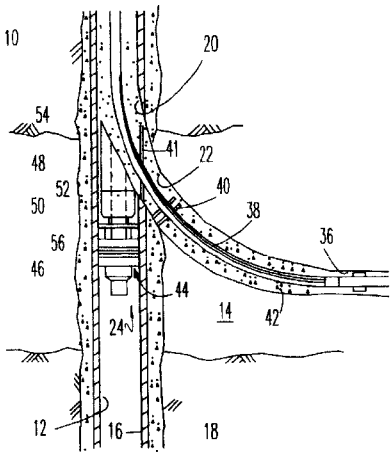

U.S. PATENT DOCUMENTS 2,281,414 A 4/1942 Clark
2,281,801 A 5/1942 Reynolds et al.
2,297,029 A 9/1942 Shepard et al.
2,324,682 A 7/1943 Long
2,331,293 A 12/1943 Ballard
2,386,514 A 10/1945 Stokes
2,397,070 A 3/1946 Zublin
2,404,341 A 7/1946 Zublin
2,434,239 A 1/1948 Zublin
2,452,920 A 11/1948 Gilbert
2,456,331 A 12/1948 Sewell
2,492,079 A 12/1949 Wiley
2,642,267 A 6/1953 Zublin
2,669,430 A 2/1954 Zublin
2,696,264 A 12/1954 Colmerauer et al.
2,726,847 A 12/1955 McCune et al.
2,788,956 A 4/1957 Pevere et al.
2,797,893 A 7/1957 McCune et al.
2,804,926 A 9/1957 Zublin
2,821,362 A 1/1958 Hatcher
2,839,270 A * 6/1958 McCune et al. ..... 175/61
2,857,002 A 10/1958 Pevere et al.
2,858,107 A 10/1958 Colmerauer
3,064,729 A 11/1962 Lindley
3,159,214 A 12/1964 Carter
3,223,158 A 12/1965 Baker
3,285,335 A 11/1966 Reistle, Jr.
3,330,349 A 7/1967 Owsley et al.
3,330,360 A 7/1967 Young
3,587,743 A 6/1971 Howard
3,842,912 A 10/1974 Lindsey
3,938,592 A 2/1976 Aladiev et al.
4,007,797 A 2/1977 Jeter
4,022,279 A 5/1977 Driver
4,068,729 A 1/1978 Peevey
4,099,783 A 7/1978 Verty et al.
4,153,109 A 5/1979 Szescila
4,160,481 A 7/1979 Turk et al.
4,182,423 A 1/1980 Ziebarth et al.
4,222,611 A 9/1980 Larson et al.
4,249,777 A 2/1981 Morrell et al.
4,258,800 A 3/1981 Hipp
4,279,301 A 7/1981 Williams
4,285,399 A 8/1981 Holland et al.
4,304,299 A 12/1981 Holland et al.
4,317,492 A 3/1982 Summers et al.
4,396,075 A 8/1983 Wood et al.
4,396,230 A 8/1983 Wood et al.
4,397,355 A 8/1983 McLamore
4,397,360 A 8/1983 Schmidt
4,402,551 A 9/1983 Wood et al.
4,407,367 A * 10/1983 Kydd ..... 166/267
4,415,205 A 11/1983 Rehm et al.
4,420,049 A * 12/1983 Holbert ..... 175/61
4,436,165 A 3/1984 Emery
4,444,276 A 4/1984 Peterson
4,489,782 A 12/1984 Perkins
4,519,463 A 5/1985 Schuh
4,523,652 A 6/1985 Schuh
4,550,781 A 11/1985 Kagler, Jr.
4,554,982 A 11/1985 Burton
4,573,540 A 3/1986 Dellinger
4,573,541 A 3/1986 Josse et al.
4,601,353 A 7/1986 Schuh et al.
4,605,076 A 8/1986 Goodhart
4,646,836 A 3/1987 Goodhart
4,696,345 A 9/1987 Hsueh
4,699,224 A * 10/1987 Burton ..... 175/61
4,714,117 A 12/1987 Dech
4,742,871 A 5/1988 Miffre
4,762,186 A * 8/1988 Dech et al. ..... 175/61
4,771,830 A 9/1988 Peate
4,807,704 A 2/1989 Hsu et al.
4,852,666 A 8/1989 Brunet
4,880,067 A * 11/1989 Jelsma ..... 175/61
4,928,767 A 5/1990 Jeisma
5,012,877 A 5/1991 Winters et al.
5,038,859 A 8/1991 Lynde et al.
5,052,482 A 10/1991 Gondouin
5,085,275 A 2/1992 Gondouin
5,109,924 A 5/1992 Jurgens et al.
5,115,872 A 5/1992 Brune et al.
5,127,457 A 7/1992 Stewart et al.
5,148,877 A 9/1992 MacGregor
5,289,876 A 3/1994 Graham
5,301,760 A 4/1994 Graham
5,318,121 A 6/1994 Brockman et al.
5,318,122 A 6/1994 Murray et al.
5,322,127 A 6/1994 McNair et al.
5,325,924 A 7/1994 Bangert et al.
5,337,808 A 8/1994 Graham
5,353,876 A 10/1994 Curington et al.
5,388,648 A 2/1995 Jordan

OTHER PUBLICATIONS

"Heavy Oil Recovery Process"; by Michael Gondouin; Oct. 13, 1991.

David Ackert, Manfred Boetel, Toni Marzalek, Christian Clavier, Peter Goode, Michael Thambynayagam and Ted Stagg, Looking Sideways for Oil, The Technical Review, vol. 36, No. 1, pp. 22–31.

Ahmed, U., Horizontal Well Completion Recommendations Through Optimized Formation Evaluation, SPE 22992, Nov. 4, 1991, pp. 423–435.

U. Ahmed and S. Jacobsen, Practical Aspects of Horizontal Well Technology: A Perspective, SPE 21260.

S.A. Andersen, S.A. Hansen, and K. Fjeldgaard, Horizontal Drilling and Completion: Denmark, SPE 18349, pp. 155–165.

Svend Aage Andersen, John M. Conlin, Kjeld Fjeldgaard, Exploiting Reservoirs with Horizontal Wells: The Maersk Experience, Oilfield Review, vol. 2, No. 3, pp. 11–21.

J.P. Ashton, J. Liput, R. Lemons, and J. Summerlin, Gravel Packing Horizontal and Highly Deviated Openhole Completions Using a Single–Screen Prepacked Liner in Offshore California Fields, SPE 19718, pp. 165–178.

Fred L. Babins, Problems in Cementing Horizontal Wells, Reservoir Selection for Horizontal Wells, pp. 1–8.

Tony Beckett and Lee Hoffpauir, Test Off Philippines Boosts Horizontal Drilling Technology, Petroleum Engineer International, Nov. 1989, pp. 24, 25, 26, 28, 30, 32.

Peter Betts, Curt Blount, Bill Broman, Brian Clark, Larry Hibbard, Alain Louis and Paul Oosthoek, Acquiring and Interpreting Logs in Horizontal Wells, Oilfield Review, vol. 2, No. 3., pp. 34–51.

W.B. Bradley, C.E. Murphey, R.T. McLamore, and L.L. Dickson, Advantages of Heavy Metal Collars in Directional Drilling and Deviation Control, Journal of Petroleum Technology, May 1976, pp. 521–530.

Gary M. Briggs, How to Design a Medium–Radius Horizontal Well, Petroleum Engineer International, Sep. 1989, pp. 26, 30, 31, 32, 36, 37.

Ernie Brown, Ron Thomas, Arthur Milne, The Challenge of Completing and Stimulating Horizontal Wells, Oilfield Review, vol. 2., No. 3., pp. 52–63.

J. Bryant, D. Watson, W. Wisniewski, R. Patterson and L. Smith, Applications and Limitations of Horizontal Drilling in Oklahoma, SPE 22569, pp. 313–326.

D. Bryant, T. Hudson, and S. Hoover, Use of Low–Density Particles for Packing a Highly Deviated Well, SPE 20984, pp. 387–395.

Trevor Burgess and Patrick Van De Slijke, Horizontal Drilling Comes of Age, Oilfield Review, vol. 2, No. 3, pp. 22–33.

Richard S. Carden, Air Drilling Has Some Pluses for Horizontal Wells, Oil & Gas Journal, Apr. 8, 1991, pp. 76–78.

Correspondence, from Matt W. Carson to William E. Shull, Dec. 2, 1996.

Christensen, Axel, Recent Achievements in Drilling and Completion of Multiple Lateral Drainholes in Chalk Reservoirs, Customer Presentation?, 1992?.

D.B. Christian, Planning and Operational Requirements for a Shallow–Objective, High–Angle Well in the Gulf of Mexico, SPE Drilling Engineering, Sep. 1988, pp. 241–247.

Gavin Clark, Piyush Shah, Bruno Deruyck, D.K. Gupta and S.K. Sharma, Horizontal Well Testing in India, Oilfield Review, vol. 2, No. 3, pp. 64–67.

S.B. Claytor, K.J. Manning and D.L. Schmalzried, Drilling a Medium–Radius Horizontal Wells with Aerated Drilling Fluid: A Case Study, SPE/IADC 21988, pp. 759–773.

S.B. Claytor Jr. and J. Speed, Steerable Systems Drilling: The Right Angle for Horizontal Drilling, SPE 19466, pp. 7–16.

R.L. Cook, J.W. Nicholson, M.G. Sheppard and W. Westlake, First Real Time Measurements of Downhole Vibrations, Forces, and Pressure Used to Monitor Directional Drilling Operations, SPE/IADC 18651, pp. 283–290.

M.F. Cooney, T. Rogers, E.S. Stacey and R.N. Stephens, Case History of an Opposed–Bore, Dual Horizontal Well in the Austin Chalk Formation of South Texas, SPE/IADC 21985, pp. 737–748.

R.E. Cooper, Coiled Tubing in Horizontal Wells, SPE 17581, pp. 323–334.

R.E. Cooper and J.C. Troncoso, An Overview of Horizonal Well Completion Technology, SPE 17582, pp. 335–350.

Kevin T. Corbett and Rapier Dawson, Drillstring Design for Directional Wells, Technology, Apr. 30, 1984, Oil & Gas Journal, pp. 61–66.

D.D. Cramer, Guides Exist for Fracture Treatment in Horizontal Wells, OGJ Special, Mar. 27, 1989, Oil & GAs Journal, pp. 41, 44, 46, 48, 49.

A. Damgaard, D.S. Bangert, D.J. Murray, R.P. Rubbo and G.W. Stout, A Unique Method for Perforating, Fracturing and Competing Horizontal Wells, SPE 19282.

Dennis Dann and David Jetelina, New Logging Approach Detects Fractures in Horizontal Wells, Petroleum Engineer International Sep. 1990, pp. 30, 32, 33, 35, 36.

James A. Dech, David D. Hearn, Frank J. Schuh and Bob Lenhart, New Tools Allow Medium–Radius Horizontal Drilling, Technology, Jul. 14, 1986, Oil & Gas Journal, pp. 95–99.

E.P. Deliac, J.P. Messines, and B.A. Thierree, Mining Technique Finds Applications in Oil Exploration, Oil & Gas Journal, May 6, 1991, pp. 84, 86, 88, 90.

H. Delafon, BHA Prediction Software Improves Directional Drilling, Part 1, World Oil, Mar. 1989, pp. 51–56, 60.

H. Delafon, BHA Prediction Software Improves Directional Drilling, Part 2, World Oil, Apr. 1989, pp. 45, 46, 47, 48, 50.

William P. Diamond and David C. Oyler, Drilling Long Horizonal Coalbed Methane Drainage Holes from a Directional Surface Borehole, SPE/DOE 8968, pp. 341–346.

W. Dickinson, R.G. Knoll, R. Nordlund and W. Dickinson, Flexible Sand Barrier (FSB): A Novel Sand Control System, SPE 18787, pp. 419–424.

W. Dickinson, R.R. Anderson and R.W. Dickinson, The Ultrashort–Radius Radial System, SPE Drilling Engineering, Sep. 1989.

Wade Dickinson, Michael J. Pesavento, R. Wayne Dickinson, Data Acquisition, Analysis, and Control While Drilling with Horizontal Water Jet Drilling Systems, CIM/SPE 90–127, pp. 127–1 thru 127–10.

Wade Dickinson, Eric Dickinson, Herman Dykstra and John M. Nees, Horizontal Radials Enhance Oil Production from a Therman Project, Oil & Gas Journal, May 4, 1992, pp. 116, 118, 120, 122, 123, 124.

Eastman, H. John, Lateral Drain Hole Drilling, Petroleum Engineer, Nov. 1954.

Eastman, H. John, Lateral Drain Hole Drilling, Petroleum Engineer, Dec. 1954.

Eastman, H. John, Lateral Drain Hole Drilling, Petroleum Engineer, Mar. 1955.

Michael J. Economides, John D. McLennan, Ernest Brown, and Jean–Claude Roegiers, Performance and Stimulation of Horizontal Wells, World Oil, Jul. 1989, pp. 69–72, 76, 77.

A. Eddison and J. Symons, Downhole Adjustable Gauge Stabilizer Improves Drilling Efficiency in Directional Wells, SPE 20454, pp. 509–516.

R. Ehlers, L. Kracht and J. Witte, Case History of Horizontal Wells Drilled with Navigation Technology in European Operations, SPE/IADC 18654, pp. 315–324.

Guy Feneyrou, French Three–Leg Multidrain Well Improves Production, OGJ Report, Oct. 1, 1984, Oil & Gas Journal, pp. 49–53.

Fincher, Roger W., "Short–Radius Lateral Drilling: A Completion Alternative," PE Int'l, Feb. 1987.

J.E. Fontenot, Successful High Angle Completions, Cementing, and Drilling's Impact, SPE 17628, pp. 831–842.

S.H. Fowler, Jr. and C.W. Pleasants, Operation and Utilization of Hydraulic–Actuated Service Tools for Reeled Tubing; SPE 20678, pp. 631–640.

Jean–Francois Glannesini, Horizontal Drilling Is Becoming Commonplace: Here's How It's Done, World Oil, Mar. 1989, pp. 35, 37, 36, 38, 40.

Lindsay Fraser, Effective Ways to Clean and Stabilize High–Angle Holes, Petroleum Engineer International, Nov. 1990, pp. 30, 32, 34, 35.

T.P. Frick and M.J. Economides, Horizontal Well Damage Characterization and Removal, SPE 21795, pp. 429–438.

G–F. Fuh and P.K. Loose, Horizontal Wellbore Stability for Openhole Completions, SPE 19717, pp. 155–164.

G.F. Fuh, D.B. Deom, and R.D. Turner, Wellbore Stability and Drilling Results from the First Horizontal Well in the Kotter Field Offshore The Netherlands, SPE 22544, pp. 101–109.

Fuh, G., Dew, E.G., Ramsey, C.A., and Collins, K., Borehole Stability Analysis for the Design of First Horizontal Well Drilled in the UK's Southern 'V' Field, SPE 20408, Sep. 23, 1990, pp. 31–42.

J.D. Fultz, F.J. Pittard, F.D. Sawyer and W.R. Farmer, Slim–Hole Drilling in Harsh Environments, IADC/SPE 19949, pp. 333–340.

Jim Fultz and Fred Pittard, Bottomhole System Works Completes Horizontal Wells, World Oil, Mar. 1990, pp. 48–50.
Andrew Gallup, B.L. Wilson and Robert Marshall, ESP's Placed in Horizontal Lateral Increase Production, Oil & Gas Journal, Jun. 18, 1990, pp. 58–60, 62–63.
D.B. Gaudin and J.C. Beasley, A Comparison of MWD and Wireline Steering Tool Guidance Systems in Horizontal Drilling, SPE 22536, pp. 7–18.
A.A. Gavignet and I.J. Sobey, A Model for the Transport of Cuttings in Highly Deviated Wells, SPE 15417.
T.M. Gaynor, Downhole Control of Deviation with Steerable Straight–Hole Turbodrills, SPE Drilling Engineering, Mar. 1988.
Gondouin, et al., The Challenge of West Sak Heavy Oil: Analysis of an Innovative Approach, SPE 22077, May 29, 1991.
Gonduoin, Heavy Oil Recovery Process, Abstract of 1$^{st}$ Qtr. Report, DPE–T1, Jan. 31, 1990.
Gonduoin, Heavy Oil Recovery Process, Third Qtrly. Report, DOE–T3, Oct. 15, 1990.
Gonduoin, Heavy Oil Recovery Process, 4$^{st}$ Qtrly. Report, DOE–T4, 31/91.
P.A. Goode and D.J. Wilkinson, Inflow Performance of Partially Open Horizontal Wells, SPE 19341, pp. 309–320.
Anthony W. Gorody, TEDSI Develops Horizontal Drilling Technology, Oil & Gas Journal, Oct. 1, 1984, OGJ Report, pp. 118, 120, 125, 126.
Robert D. Grace, Mike Pippin, Downhole Fires During Air Drilling: Causes and Cures, World Oil, May 1989, pp. 42–44.
Stephen A. Graham, Bruce Henderson & Greg Nazzal, Drilling a Dual–Bore Horizontal Well in the Austin Chalk: A Case History, ASME 91–PET.
Stephen A. Graham and Greg Nazzal, Second Lateral in Horizontal Well Solves Water, Problem Oil & Gas Journal, Mar. 18, 1991, pp. 111–114.
John F. Greenip Jr., How to Design Casing Strings for Horizontal Wells, Petroleum Engineer International, Dec. 1989; pp. 34–38.
Kenneth B. Gunn, Well Cored to 9,800 Ft. in Paraquay, Oil & Gas Journal, Mar. 13, 1991, pp. 51–55.
Douglas Gust, Horizontal Drilling Evolving from Art to Science, Technology, Jul. 24, 1989, Oil & Gas Journal, pp. 43–46, 49–52.
R.C. Haas and C.O. Stokley, Drilling and Completing a Horizontal Well in Fractured Carbonate, World Oil, Oct. 1989, pp. 39, 40, 42, 44, 45.
D.J. Hall, J.L. Walker, E.G. Schmelzl, and T.B. Haene, Logging and Perforating of Horizontal Wells: An Innovative Approach, SPE 21836, pp. 307–316.
L.R.B. Hammons, W.C. Barnett, E.K. Fisher and D.H. Sellers, Stratigraphic Control and Formation Evaluation of Horizontal Wells Using MWD, SPE 22538, pp. 25–38.
Hardeman, P., Beckingham 36 Horizontal Well, SPE Drilling Engineering, Mar. 1989, pp. 17–23.
P.E. Harness, M.D. Hansen, G.A. Terzian, S.H. Fowler, Jr. and F.J. Golino, An Overview of Reeled–Tubing–Conveyed Production Logging Capabilities in California, SPE 20028, pp. 155–163.
Floyd Harvey, Fluid Program Built Around Hole Cleaning, Protecting Formation, Oil & Gas Journal, Nov. 5, 1990, pp. 37–41.
Pat Herbert, Drilling with New–Generation Positive Displacement Motors, SPE 10239.
Hesse, Karl, Multilateral Drilling—A Case History, Customer Presentation?, Nov. 25, 1992.
D.R. Holbert, New Interest in Drainhole Drilling Revives Technology, World Oil, Mar. 1981, pp. 57, 58, 61, 62, 64, 66, 70, 72.
Holifield & Associates, Pearsall and Giddings Austin Chalk Horizontal/Directional Drilling Program, Quote to Customer?, Jun. 1, 1991.
Ray H. Holifield, Bill Rehm, Recompletion by Horizontal Drilling Pays Off, World Oil, Mar., 1989, pp. 42, 43, 50.
Holton, David S., How Shell Handles Remedial Jobs at Ventura, Petroleum Engineer, Jan. 1963.
J.L. Hood III, M.D. Mueller, and M.G. Mims, The Uses of Buoyancy in Completing High–Drag Horizontal Wellbores, SPE 23027, pp. 757–764.
M.R. Islam and A.E. George, Sand Control in Horizontal Wells in Heavy Oil Reservoirs, SPE 18789, pp. 437–452.
Warren Jones, Unusual Stresses Require Attention to Bit Selection, Oil & Gas Journal, Oct. 22, 1990, pp. 81–85.
Joshi, S.D., Proper Completion Critical for Horizontal Wells, Special Report, Johsi Technologies International, Inc., Jan. 1990.
Joshi, S.D., "A Review of Horizontal Well and Drainhole Technology" SPE paper 16868, presented at the 62$^{nd}$ Annual Technical Conference and Exhibition of the Society of Petroleum Engineers, Dallas, TX, Sep. 27–30, 1987.
Jurgens, R., Bitto, R., Henderson, B., White, C., and Mullins, G., Horizontal Drilling and Completions: A Review of Available Technology, Petroleum Engineer International, Feb., 1991, pp. 14–21.
Rainer Jurgens, Ron Bitto, Bruce Henderson, Cameron White and Gus Mullins, Horizontal Drilling and Completions: A Review of Available Technology, Petroleum Engineer International, Mar., 1991, pp. 32–34, 36–37.
H. Karisson, R. Cobbley, and G.E. Jaques, New Developments in Short, Medium, and Long–Radius Lateral Drilling, SPE/IADC 18706, pp. 725–736.
Heraldur Karisson and Ron Bitto, Worldwide Experience Shows Horizontal Well Success, World Oil, Mar. 1989, pp. 51–54, 56.
L. Keelean, S.S. Harris and N. Petronio, Short Radius Drilling Technology Utilizing Mobile Service/Workover Rig, SPE/IADC 18711, pp. 765–772.
D. Kerr and K. Lesley, Mechanical Aspects of Medium Radius Well Design, SPE 17618, pp. 719–726.
Denny Kerr, Designing Tangent Sections for Medium–Radius Horizontal Wells, World Oil, Mar. 1991, pp. 45–47.
Denny Kerr, How to Drill a Smooth Medium–Radius Well, World Oil, Mar. 1990, pp. 46–47.
G.E. King, Perforating the Horizontal Well, Journal of Petroleum Technology, Jul. 1989, pp. 671–672.
William King, Selecting Bits for Extended Reach and Horizontal Wells, World Oil, Apr. 1990, pp. 55–57, 59–60.
Kuich, Seismic and Horizontal Drilling Unlock Austin Chalk, World Oil, Sep. 1990, pp. 47, 48, 50, 52, 54.
M.J. Landman and W.H. Goldthorpe, Optimization of Perforation Distribution for Horizontal Wells, SPE 23005, pp. 567–576.
William J. Lang and Marion B. Jett, High Expectations for Horizontal Drilling Becoming Reality, Oil & Gas Journal, Sep. 24, 1990, OGH Special, pp. 70, 74, 76, 79.

R.C. Leaf and F.J. Pittard, Review of Horizontal Methods and Drilling Technology, SPE 21862, pp. 575–584.

J. Lessi and A. Spreux, Completion of Horizonal Drainholes, SPE 17572, pp. 209–218.

T.K. Li, V. Chandelle, and J. Brych, Lateral Drilling: A New Application Shows Promise, World Oil, Jun. 1986, pp. 68–71.

Jeff H. Littleton, Sohio Studies Extended–Reach Drilling for Prudhoe Bay, Petroleum Engineer International, Oct. 1985, pp. 28, 32, 34.

D. Malekzadeh and D. Tiab, Interference Testing of Horizontal Wells, SPE 22733, pp. 717–727.

Christian Mariotti and Evelyne Kou, Elf Improves Horizontal Drilling at Rospo Mare, Petroleum Engineer International, Aug. 1988, pp. 30, 32, 35.

C.M. Matthews and L.J. Dunn, Drilling and Production Practices to Mitigate Sucker Rod/Tubing Wear–Related Failures in Directional Wells, SPE 22852, pp. 363–374.

Ron Matson and Rod Bennett, Cementing Horizontal Holes Becoming More Common, Oil & Gas Journal, Dec. 17, 1990, pp. 40–46.

Maurer Engineering, Inc., "Evaluation of Branch and Horizontal Boreholes for in Situ Leach Mining," U.S Dept. of the Interior, Bureau of Mines Paper (Maurer), 07/8.

G.K. McKown, Drillstring Design Optimization for High–Angle Wells, SPE/IADC 18650, pp. 275–282.

J. Misselbrook, G. Wilde and K. Falk, The Development and Use of a Coiled–Tubing Simulation for Horizontal Applications, SPE 22822, pp. 29–41.

T.J. Moo and M.W. Tweedy, Planning and Drilling Australia's First Medium–Radius Horizontal Wells, SPE 23013, pp. 629–640.

Steven D. Moore, Meridian Oil Finds Success with Horizontal Wells; Petroleum Engineer International, Nov. 1989, pp. 17, 18, 19, 20, 22.

W.D. Moore III, ARCO Drills Horizontal Drainhole for Better Reservoir Placement, Oil & Gas Journal, Sep. 15, 1980, pp. 139–148.

Guntis Moritis, Horizontal Drilling Scores More Successes, Oil & Gas Journal, OGJ Special, Feb. 26, 1990, pp. 53, 54, 58, 62, 63, 64.

Guntis Moritis, Horizontal Drilling Technology Keeps Advancing, Oil & Gas Journal, OGJ Special, Mar. 11, 1991, pp. 49–53.

Muriby, et al., Horizontal Drilling Success Offshore ABU Dhabi, SPE 21311, Nov. 16, 1991.

F.R. Myal and K–H. Frohne, Slant–Hole Completion Test in the Piceance Basin, Colorado, SPE 21866, pp. 611–622.

S.B. Nice and W.H. Fertl, Logging, Competing Extended–Reach and Horizontal Wells, World Oil, Mar. 1991, pp. 49, 50, 52, 53, 55, 56.

Sid B. Nice, Leading Edge Logging, Well Logging and Completion Technology for Horizontal Wellbores, Popular Horizontal, p. 4.

Sid B. Nice and W.H. Fertl, New Logging, Completion Techniques Boost Horizontal Well Productivity, Petroleum Engineer International, Nov. 1990, pp. 20, 22, 23, 26.

G. Norel, C. Bubois, and G. Georges, Test Bench Checks Cement in Horizontal Holes, Petroleum Engineer International, Nov. 1988, pp. 54–59.

Parcevaux, Philippe, Guides Emerge for Cementing Horizonal Strings, OGJ, Oct. 19, 1987.

Parsons, et al., "Short–Radius Lateral Drilling: A Completion Alternative," Society of Petroleum Engineers (SPE), Paper #15943, Nov. 12, 1986, Richardson, Texas.

Larry E. Pendleton and A. Behrooz Ramesh, Bechtel Develops Innovative Method for Horizontal Drilling, Technology, May 27, 1985, Oil & Gas Journal, pp. 95–99.

C.J. Perry, Directional Drilling with PDC Bits in the Gulf of Thailand, SPE 15616.

Dr. A.S. Pocovi and Lic. L. Gustavino, Dr. A. Pozzo and Eng. J.A. Musmarra, Comparing Cost and Performance of Horizontal Wells, World Oil, Mar. 1991, pp. 39, 40, 42–44.

Pope, C.D., and Handren, P.J., Completion Techniques for Horizontal Wells in the Pearsall Austin Chalk, SPE 20682, Sep. 23, 1990, pp. 657–664.

Michael M. Power, Roger Chapman, and Robert O'Neal, Horizontal Well Sets Depth Record Completing Deep Horizontal Well, Petroleum Engineer International, Nov. 1990, pp. 37–38.

Michael M. Power, Roger Chapman, and Robert O'Neal, Horizontal Drilling Below 14,600 Ft; Petroleum Engineer International, Nov. 1990, p. 36.

Prevedel, B., "New Techniques in Horizontal and Drainhole Drilling Optimization: Lehrte 41 Lateral Drilling Project," SPE 15694, Mar. 7, 1987.

Bernhard Prevedel, Case History: How One Operator Drilled Horizontally Through a Salt Dome, World Oil, Dec. 1985, pp. 69, 73, 76, 80.

R.H. Reiley, J.W. Black, T.O. Stagg, D.A. Walters and G.R. Atol, Cementing of Liners in Horizontal and High–Angle Wells at Prudhoe Bay, Alaska, SPE 16682, pp. 583–590.

R.H. Reiley, J.W. Black, T.O. Stagg, D.A. Walters and G.R. Atol, Improving Liner Cementing in High–Angle/Horizontal Wells, World Oil, Jul. 1988, pp. 69, 71, 73, 74.

O. Rivas, A Newsky, M. Cedeno, P. Rivera, Sucker Rod Centralizers for Directional Wells, SPE 21131.

O.L.A. Santos, Important Aspects of Well Control for Horizontal Drilling Including Deepwater Situations, SPE/IADC 21993, pp. 785–796.

S. Schellenberg, T. Rogers and L. Smith, Deviation Control with Steerable System Lowers Well Costs in Southern Oklahoma, SPE 22567, pp. 299–312.

L. McDonald Schetky, Shape–Memory Alloys, Nov. 1979, vol. 241, No. 5, pp. 2–10.

D.R. Schroeter and H.W. Chan, Successful Application of Drilling Technology Extends Directional Capability, SPE Drilling Engineering, Sep. 1989, pp. 230–236.

Siegfried K. Schueler, Horizontal Well Improves Recovery in Deep Sour Gas Field, Oil & Gas Journal, Mar. 23, 1992, pp. 93, 94, 96, 97.

L. Shale, Development of Air Drilling Motor Holds Promise for Specialized Directional Drilling Applications, SPE 22564, pp. 275–286.

Les Shale, Downhole Motor Specifically Designed for Directional Air Drilling, Oil and Gas Journal, Feb. 3, 1992, pp. 45–49.

D.W. Sherrard, B.W. Brice and D. G. MacDonald, Application of Horizontal Wells at Prudhoe Bay, SPE 15376, pp. 1–8, tables 1–15.

Correspondence, from William E. Shull to Matt W. Carson, Oct. 2, 1996.

R.A. Skopec, M.M. Mann, D. Jeffers and S.P. Grier, Horizontal Core Acquisition and Orientation for Formation Evaluation, SPE 20418, pp. 153–166.

M.Y. Soliman, James L. Hunt and A.M. El Rabaa, Fracturing Aspects of Horizontal Wells, Aug. 1990, JPT.
Mohamed Soliman, Bob Rose, Wadood El Rabaa and James L. Hunt, Planning Hydraulically Fractured Horizontal Completions, World Oil, Sep. 1989, pp. 54–56, 58.
Derry D. Sparlin and Raymond W. Hagen, Jr., Controlling Sand in a Horizontal Completion, World Oil, Nov. 1988, pp. 54–58.
A. Spreux, A. Louis, M. Rocca, Logging Horizontal Wells–Field Practice for Various Techniques, SPE 16565, pp. 1–14.
Alain Spreux, Christian Georges, and Jacques Lessi, Most Problems in Horizontal Completions Are Resolved, Technology, Oil & Gas Journal, Jun. 13, 1988, pp. 48–52.
Stagg and Reiley, Horizontal Well Completions in Alaska, World Oil, Mar. 1990, pp. 37–44.
Carl W. Stang, Alternative Electronic Logging Technique Locates Fractures in Austin Chalk Horizontal Well, Oil & Gas Journal, Nov. 6, 1989, Technology, pp. 42–45.
Steenbock, et al., "Alternative Drainhole Drilling System—Theoretical Background and Practical Experience."
Stormont, D.H., "Increasing Drainage of Oil into Well by Drain–Hole Drilling," Oil and Gas Journal, Aug. 17, 1953.
R.J. Tailby, J.H. Yonker and J.L. Pearce, A New Technique for Servicing Horizonal Wells, SPE 22823, pp. 43–58.
Todd Talbot, Dual Horizontal Well Completion, Baker Oil Tools, Dec. 8, 1992.
Talk et al., Special Liner Design Improves Dual Lateral Horizontal Well, OGJ, Aug. 31, 1992.
Glen Tolle, Thomas Dellinger, Mobil Identifies Extended–Reach–Drilling Advantages, Possibilities in North Sea, Oil & Gas Journal, May 26, 1986, Technology, pp. 78, 81–86.
D.K. Trichel and M.P. Ohanlan, Unique Articulated Downhole Motor Holds Promising Future for Short Radius Horizonal Drilling, SPE 20417, pp. 137–149.
Y. Tsukano and M. Ueno, Development of Lightweight Steel Drillpipe with 165–ksi Yield Strength, IADC/SPE 19960, pp. 403–412.
H.J. Vrielink and A.M. Hippman, Optimization of Slant Well Drilling in the Lindberg Field, SPE Drilling Engineering, Dec. 1989, pp. 307–314.
M.B. Webster, G.E. Otott Jr. and D.L. Rice, Cementing High–Angle–Wells Using Cement–Expanded Formation Packers and/or Casing Rotation, SPE/IADC 16136, pp. 745–754.
J.B. Weirich, T.E. Zaleski Jr., and P.M. Mulcahy, Perforating the Horizontal Well: Designs and Techniques Prove Successful, SPE 16929, pp. 503–508.
C.W. White, Drilling and Completion of a Horizontal Lower Spraberry Well Including Multiple Hydraulic Fracture Treatments, SPE 19721, pp. 205–210.
Cameron White and Mark Hopmann, Controlling Flow in Horizontal Wells, World Oil, Nov. 1991.
Cameron White, Formation Characteristics Dictate Completion Design, Oil & Gas Journal, Dec. 3, 1990, pp. 58–62, 64.
J.P. Wilkerson, J.H. Smith, T.P. Stagg and D.A. Walters, Horizontal Drilling Techniques at Prudhoe Bay, Alaska, SPE 15372.
M.A. Wilson and F.L. Sabins, A Laboratory Investigation of Cementing Horizontal Wells, SPE Drilling Engineering, Sep. 1988, pp. 275–280.
R.C. Wilson and D.N. Willis, Successful High Angle Drilling in the Statfjord Field, SPE 15465, pp. 1–13.
Bruce Woodlan and G.E. Powell, Casing Design in Directionally Drilled Wells, SPE 5352, pp. 1–12.
Jiang Wu, Ping Chen and Hans. C. Juvkam–Wold, Casing Centralization–Centralization of Casing in Horizontal Wells, Popular Horizontal, Apr./Jun. 1991, pp. 14–21.
Jiang Wu, Hans C. Juvkam–Wold, Drag and for Horizontal Wells Simplified for Field Use, Oil & Gas Journal, Apr. 29, 1991, pp. 49–53, 56.
T.E. Zaleski, Jr., Sand–Control Alternatives for Horizonal Wells, JPT, May 1991.
Theodore E. Zaleski, Jr and Jefferson P. Ashton, Gravel Packing Feasible in Horizontal Well Completions, Oil & Gas Journal, Jun. 11, 1990, pp. 33–37.
Chris Zimmerman and Donny Winslow, How to Select the Right Tools for Stimulating Horizontal Wells, World Oil, Nov. 1989, pp. 53–36.
C. Zurdo, C. Georges, and M. Martin, Mud and Cement for Horizontal Wells, SPE 15464.
Cementing of Horizontal Wells, Horizontal Well Completions, pp. 9–14.
Drilling Fluids for Horizonal Wells, Oilfield Review, vol. 2, No. 3, pp. 8–10.
Fracturing of Horizontal Wells, Horizontal Well Completions, Western International, pp. 23–30.
Staff Report, Getting to the Bottom with Slant–Hole Logging Tools, Petroleum Engineer International, Feb. 1988, pp. 32, 34.
Horizontal Drilling Records Recognized, Petroleum Engineer International, Feb. 1988, p. 35.
Horizontal Drilling Stays Hot; Petroleum Engineer International, Apr. 1989, Petroleum Engineer International, p. 24.
Schlumberger, Horizontal Wells–Reach Out for Reservoir Data to Maximize Productivity from Your Horizontal Well; Petroleum Engineer International, Nov. 1990, pp. 40–41.
Horizontal Well Case Histories, Horizontal Well Completions, Western International, pp. 31–37.
New Logging Techniques, Petroleum Engineer International, Nov. 1990, pp. 27–29.
Matrix Stimulation of Horizontal Wells, Western International, pp. 15–21.
Reservoir Selection for Horizontal Wells, Western International, pp. 1–8.
SPE 20005, JPT, Apr. 1990, pp. 399–400.
S. Barua "Completion of Heat Transfer in Wellbores with Single and Dual Completions," SPE paper 22868, presented at the 66$^{th}$ Annual Technical Conference and Exhibition of the Society of Petroleum Engineers, Dallas, TX, Oct. 6–9, 1991.
Butler, R.M., "A New Approach to the Modeling of Steam–Assisted Gravity Drainage," J.Cdn.Pet.Tech., May–Jun. 1985, pp. 417–421.
Cooper, et al., "Deep Heavy–Oil Recovery by Steam Injection Using Twin Horizontal Drainholes," Society of Petroleum Engineers 24088, Mar. 30–Apr. 1, 1992.
Natural Reserves Group, Inc. v. Baker Hughes, Inc. et al. (District Court Harris County, Texas 333$^{rd}$ Judicial District) No. 96–31380—Pleadings and documents.
Exhibit A: Plaintiff's Original Petition, Jun. 21, 1996.
Exhibit B: Defendants' Original Answer, Jul. 29, 1996.
Exhibit C: Agreed Protective Order (signed by Judge), Oct. 11, 1996.

Exhibit D: Scheduling Order, Oct. 17, 1996.
Exhibit E: Defendants' Original Counterclaim, Apr. 23, 1997.
Exhibit F: Plaintiff's First Amended Original Petition, Sep. 4, 1997.
Exhibit G: Defendants' Motion for Leave to File Defendants' Amended Motion for Summary Judgment on All Claims in Plaintiff's First Amended Original Petition, Sep. 12, 1997.
Exhibit H: Defendants' Amended Motion for Summary Judgment on All Claims in Plaintiff's First Amended Original Petition, Sep. 12, 1997.
Exhibit I: Plaintiff's Second Amended Original Petition, Sep. 25, 1997.
Exhibit J: Plaintiff's Response to Defendants' Amended Motion for Summary Judgment on All Claims in Plaintiff's First Amended Original Petition, Oct. 30, 1997.
Exhibit K: Stipulation Between NRG and Halliburton Regarding Exchange of "Confidential" and "Highly Confidential" Information.
Exhibit L: Defendants' Reply Memorandum in Support of Motion for Summary Judgment on All Claims Based on Defendants' Independent Development of Information Contained in Baker Hughes' Patents, Dec. 3, 1997.

Exhibit M: Plaintiff's Third Amended Original Petition, Mar. 3, 1998.

Exhibit N: Supplemental Agreed Protective Order Between Baker Hughes Incorporated et al., Halliburton Energy Services, Inc., Halliburton Company and Sperry–Sun Drilling Services, Inc. Mar. 30, 1998.

Exhibit O: Natural Reserves Group, Inc. v. Baker Hughes, Inc. Docket Sheet, Jul. 24, 1998.

Cooper, G.A., and M. Gondouin, "Improved Steam Stimulation of Heat Oil Wells," Final Report on California Competitive Technology Project No. CT 90 A–046–RW (submitted Nov. 1991).

* cited by examiner

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 15–21 is confirmed.

Claims 1, 2, 3, 4 and 11 are determined to be patentable as amended.

Claims 5–10 and 12–14, dependent on an amended claim, are determined to be patentable.

New claims 22–46 are added and determined to be patentable.

1. In a process of completing a horizonal well in a hydrocarbon formation comprising the steps of providing a vertical well, drilling a curved well bore from the vertical well, drilling a horizontal well bore into the formation through the curved well bore, positioning a first section of a pipe string in the curved well bore and a second section of the pipe string in the vertical well, and cementing the pipe string in the curved well bore, the improvement comminuting the pipe string in the vertical well and thereby providing a passage between the horizontal well bore section and the vertical well and then producing hydrocarbons from the horizontal well bore section through the passage into the vertical well, *and wherein the step for providing a vertical well further comprises providing casing in the vertical well and forming an opening in the vertical cased well and then drilling the curved well bore through the opening, wherein the second section of pipe string extends beyond the opening and axially into the vertical well, and further including the step of applying cement in sufficient amount to close off the opening, to extend beyond the opening and axially into the cased vertical well, and to extend about the first and second sections of pipe string, to form a seal.*

2. The process of claim 1 wherein the providing step comprises [drilling a vertical open hole and then] drilling the curved well bore by sidetracking from the *opening in the* vertical [open hole] *well* at a location above the bottom of the vertical [open hole] *well.*

3. [The process of claim 1] *In a process of completing a horizontal well in a hydrocarbon formation comprising the steps of providing a vertical well, drilling a curved well bore from the vertical well, drilling a horizontal well bore into the formation through the curved well bore, positioning a first section of a pipe string in the curved well bore and a second section of the pipe string in the vertical well, and cementing the pipe string in the curved well bore, the improvement comprising comminuting the pipe string in the vertical well and thereby providing a passage between the horizontal well bore section and the vertical well and then producing hydrocarbons from the horizontal well bore section through the passage into the vertical well, and* wherein the providing step comprises providing a vertical cased well and cutting a window through the vertical cased well and then drilling the curved well bore through the window, *wherein the second section of pipe string extends beyond the window and axially into the vertical well, and further including the step of applying cement in sufficient amount to close off the window, to extend beyond the window and axially into the cased vertical well, and to extend about the first and second sections of pipe string, to form a seal.*

4. [The process of claim 1] *In a process of completing a horizontal well in a hydrocarbon formation comprising the steps of providing a vertical well, drilling a curved well bore from the vertical well, drilling a horizontal well bore into the formation through the curved well bore, positioning a first section of a pipe string in the curved well bore and a second section of the pipe string in the vertical well, and cementing the pipe string in the curved well bore, the improvement comprising comminuting the pipe string in the vertical well and thereby providing a passage between the horizontal well bore section and the vertical well and then producing hydrocarbons from the horizontal well bore section through the passage into the vertical well, and* wherein the step of drilling the curved well bore comprises setting a plug in the vertical well and then drilling the curved well bore at a location starting above the bottom of the plug and further comprising the steps of removing the plug from the vertical well to provide a sump below an intersection of the curved well bore and the vertical well, placing a pump in the sump and the producing step comprises pumping liquid hydrocarbons from the sump upwardly through the vertical well.

11. [The process of claim 1] *In a process of completing a horizontal well in a hydrocarbon formation comprising the steps of providing a vertical well, drilling a curved well bore from the vertical well, drilling a horizontal well bore into the formation through the curved well bore, positioning a first section of a pipe string in the curved well bore and a second section of the pipe string in the vertical well, and cementing the pipe string in the curved well bore, the improvement comprising comminuting the pipe string in the vertical well and thereby providing a passage between the horizontal well bore section and the vertical well and then producing hydrocarbons from the horizontal well bore section through the passage into the vertical well, and* wherein the cementing step comprises affixing a plurality of radial metallic elements to the pipe string along a predetermined zone, running the pipe string into the well and positioning the zone at a location below an intersection of the curved well bore and the vertical well, and filling up an annulus between the pipe string and the curved well bore with a hardenable impermeable material and the comminuting step comprises comminuting the pipe string and cement in the vertical well.

*22. The process of claim 1 wherein cement is applied between the outer surface of the pipe string in the vertical well and the surrounding inner surface of the casing in the vertical well.*

*23. The process of claim 1 wherein the comminuting step comprises removing the portion of the cement and pipe string inside the vertical well.*

*24. The process of claim 23 wherein said removing step comprises cutting away a periphery of the cement and pipe string and retrieving the remnant upwardly through the vertical well.*

*25. The process of claim 1 wherein the step of drilling the curved well bore comprising setting a plug in the vertical well and then drilling the curved well bore at a location starting above the plug.*

*26. The process of claim 25 further comprising the step of removing the plug from the vertical well to provide a sump below an intersection of the curved well bore and the vertical well.*

*27. The process of claim 26 further comprising the step of placing a pump in the sump and pumping liquid hydrocarbon from the sump upwardly through the vertical well.*

*28. The process of claim 25 wherein the plug includes a diverter assembly.*

*29. The process of claim 28 wherein said diverter assembly includes a packer and a whipstock.*

*30. The process of claim 1 wherein the step of drilling a curved well bore comprises setting a whipstock in the vertical well and using the whipstock to direct a cutting tool through the opening and into the formation.*

*31. The process of claim 30 wherein the whipstock includes an axial bore open at the top of the whipstock.*

*32. The process of claim 1 further comprising the step of applying centralizers to the pipe string to support the pipe string off the bottom of the curved well.*

*33. The process of claim 1 further comprising applying reinforcing members proximate the opening to reinforce the cement adjacent the opening.*

*34. The process of claim 1 wherein an additive is added to the cement to make the hardened cement less brittle with more resiliency to shock and vibration loading.*

*35. The process of claim 1 wherein one or more mechanical extensions are fixed to the pipe string to support the pipe string.*

*36. The process of claim 1 wherein one or more mechanical extensions are fixed to the pipe string to cooperate with the cement and strengthen the joint between the vertical well and the curved well bore.*

*37. The process of claim 1 wherein the comminuting step comprises cutting an annulus through the pipe string and cement in the vertical well and removing the cut pipe string and cement upwardly through the vertical well.*

*38. The process of claim 1 wherein the step of forming an opening comprises removing a portion of the casing.*

*39. The process of claim 38 wherein the step of removing a portion of the casing comprises cutting a window in the casing.*

*40. The process of claim 4 wherein the plug includes a diverter assembly.*

*41. The process of claim 4 wherein said diverter assembly includes a packer and a whipstock.*

*42. The process of claim 4 wherein the plug includes a whipstock.*

*43. The process of claim 42 wherein the whipstock includes an axial bore open at the top of the whipstock.*

*44. The process of claim 4 further comprising the step of applying centralizers to the pipe string to support the pipe string off the bottom of the curved well.*

*45. The process of claim 4 wherein one or more mechanical extensions are fixed to the pipe string to support the pipe string.*

*46. The process of claim 4 wherein one or more mechanical extensions are fixed to the pipe string to cooperate with the cement and strengthen the joint between the vertical well and the curved well bore.*

* * * * *